US010393401B2

(12) United States Patent
Pridemore et al.

(10) Patent No.: US 10,393,401 B2
(45) Date of Patent: Aug. 27, 2019

(54) DIRECT DRIVE MOTOR INTEGRATED INTO DAMPER BLADE

(71) Applicant: Johnson Controls Technology Company, Holland, MI (US)

(72) Inventors: Clark E. Pridemore, Grand Rapids, MI (US); Steve R. Palasek, Lowell, MI (US); Harvey Pastunink, Hudsonville, MI (US); Joseph Tyler Devine, Livonia, MI (US); James Charles Sharp, Lawton, MI (US); Robert Gerald Lee, Mason, MI (US)

(73) Assignee: Air Distribution Technologies IP, LLC, Milwaukee, WI (US)

( * ) Notice: Subject to any disclaimer, the term of this patent is extended or adjusted under 35 U.S.C. 154(b) by 30 days.

(21) Appl. No.: 15/243,206

(22) Filed: Aug. 22, 2016

(65) Prior Publication Data

US 2018/0051904 A1 Feb. 22, 2018

(51) Int. Cl.
*F24F 13/14* (2006.01)
*F24F 13/15* (2006.01)

(52) U.S. Cl.
CPC ..... *F24F 13/15* (2013.01); *F24F 13/1426* (2013.01); *F24F 13/1486* (2013.01); *F24F 2013/1433* (2013.01)

(58) Field of Classification Search
CPC ..... F24F 13/15; F24F 13/082; F24F 13/1486
USPC ..... 454/335
See application file for complete search history.

(56) References Cited

U.S. PATENT DOCUMENTS

| | | | | |
|---|---|---|---|---|
| 4,256,143 | A * | 3/1981 | Magill | F24F 13/15 137/601.06 |
| 4,417,687 | A | 11/1983 | Grant | |
| 5,441,451 | A * | 8/1995 | Jeung | F24F 13/1413 454/313 |
| 5,842,919 | A * | 12/1998 | Lyons | F24F 13/15 137/601.11 |
| 6,692,349 | B1 | 2/2004 | Brinkerhoff et al. | |
| 7,156,316 | B2 | 1/2007 | Kates | |
| 7,163,156 | B2 | 1/2007 | Kates | |
| 7,168,627 | B2 | 1/2007 | Kates | |
| 7,455,236 | B2 | 11/2008 | Kates | |
| 7,455,237 | B2 | 11/2008 | Kates | |
| 2010/0163633 | A1* | 7/2010 | Barrett | B60H 1/00871 236/49.3 |
| 2012/0072030 | A1 | 3/2012 | Elliott | |
| 2015/0130631 | A1 | 5/2015 | Patel et al. | |
| 2015/0133043 | A1 | 5/2015 | Patel et al. | |
| 2016/0153674 | A1 | 6/2016 | Lancaster | |

* cited by examiner

*Primary Examiner* — Steven B McAllister
*Assistant Examiner* — Allen R Schult
(74) *Attorney, Agent, or Firm* — Fletcher Yoder, P.C.

(57) ABSTRACT

A damper, comprising a plurality of blades, a plurality of blade arms, each blade arm coupled to one of the plurality of blades and a motor coupled to one of the blades and one of the blade arms.

16 Claims, 10 Drawing Sheets

DIRECT DRIVE MOTOR INTEGRATED INTO DAMPER BLADE

TECHNICAL FIELD

The present disclosure relates generally to heating, ventilation and air conditioning (HVAC) equipment, and more specifically to a direct drive motor that is integrated into a damper blade to provide improved efficiency and control of damper blade positions.

BACKGROUND OF THE INVENTION

Motor-controlled damper positioners are known in the art. The motor is usually disposed adjacent to the damper blades.

SUMMARY OF THE INVENTION

A damper is disclosed that includes a plurality of blades and a plurality of blade arms, where each blade arm is coupled to one of the plurality of blades. A motor shaft is connected to a support that is coupled to one of the blades, which causes the damper and motor assembly to rotate.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE SEVERAL VIEWS OF THE DRAWINGS

Aspects of the disclosure can be better understood with reference to the following drawings. The components in the drawings may be to scale, but emphasis is placed upon clearly illustrating the principles of the present disclosure. Moreover, in the drawings, like reference numerals designate corresponding parts throughout the several views, and in which.

DETAILED DESCRIPTION OF THE INVENTION

Figure 1:
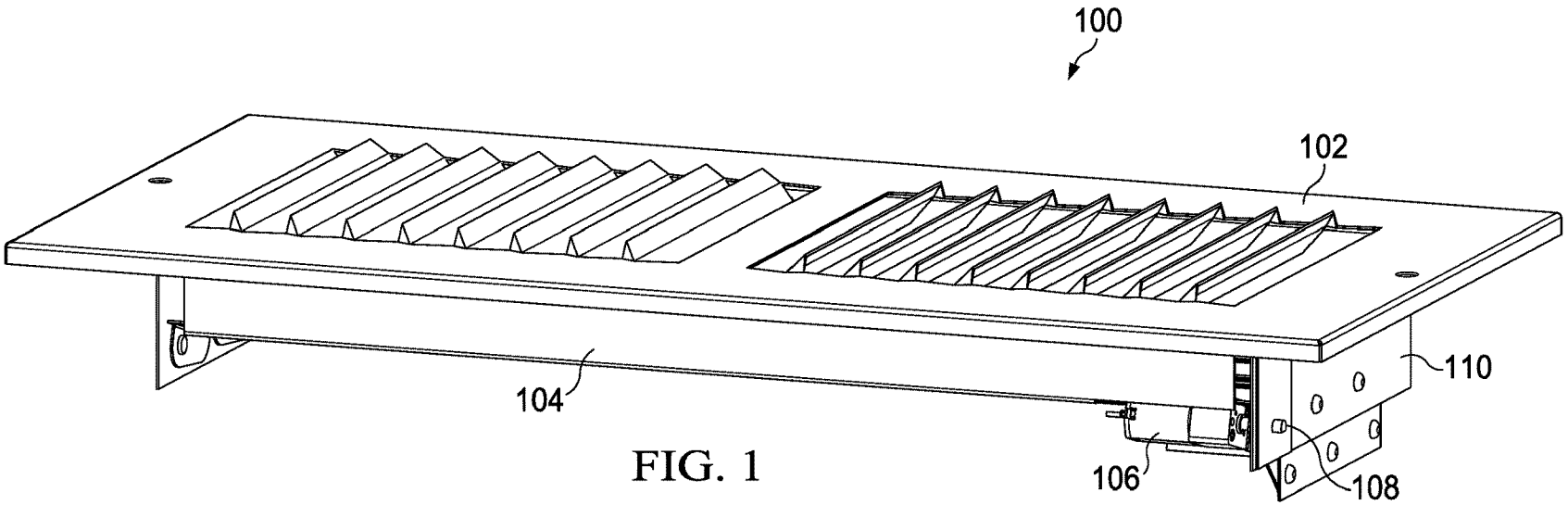
FIG. 1 is an isometric diagram of a damper unit, in accordance with an exemplary embodiment of the present disclosure.

In the description that follows, like parts are marked throughout the specification and drawings with the same reference numerals. The drawing figures may be to scale and certain components can be shown in generalized or schematic form and identified by commercial designations in the interest of clarity and conciseness.

As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

FIG. 1 is an isometric diagram of a damper unit 100, in accordance with an exemplary embodiment of the present disclosure. Damper unit 100 can be fabricated from metal, plastic, composite materials, other suitable materials or a combination of materials, and includes grill 102, baffle 104, actuator 106, drive shaft 108 and support 110.

Grill 102 can provide fixed or movable vents, and is configured to attach to a standard residential or business HVAC duct. In one exemplary embodiment, grill 102 can be used to replace an existing grill that has been previously installed. In another exemplary embodiment, grill 102 can be used with a tethered energy recovery and control device.

Baffle 104 is disposed on grill 102 and forms a seal between grill 102 and the HVAC duct that grill 102 is disposed on. In one exemplary embodiment, baffle 104 can be cut to fit an HVAC duct, can be formed from flexible seal materials, or can otherwise be configured to provide an air-tight seal between grill 102 and the HVAC duct.

Actuator 106 is disposed on a damper blade and is used to cause the damper blade assembly to open and close upon receipt of motive power. In one exemplary embodiment, actuator 106 can be a direct drive DC motor, a stepper motor or other suitable motive power source.

Drive shaft 108 is keyed to interlock with a drive mechanism (not explicitly shown). In one exemplary embodiment, the key can include one or more interlocking surfaces that are used to convey torque or other suitable forces to the drive mechanism.

Support 110 holds a plurality of damper blade bearings or other suitable mechanical devices for allowing damper blades to move in a predetermined manner, such as to rotate open or closed, as well as a drive mechanism that is used to cause the damper blades to move, such as to rotate open and closed. In one exemplary embodiment, support 110 can also operate as a baffle to form a seal against the HVAC duct that grill 102 is disposed on.

In operation, damper unit 100 can be used to provide an interface between an HVAC duct and a room or other temperature controlled environment.

Figure 2:
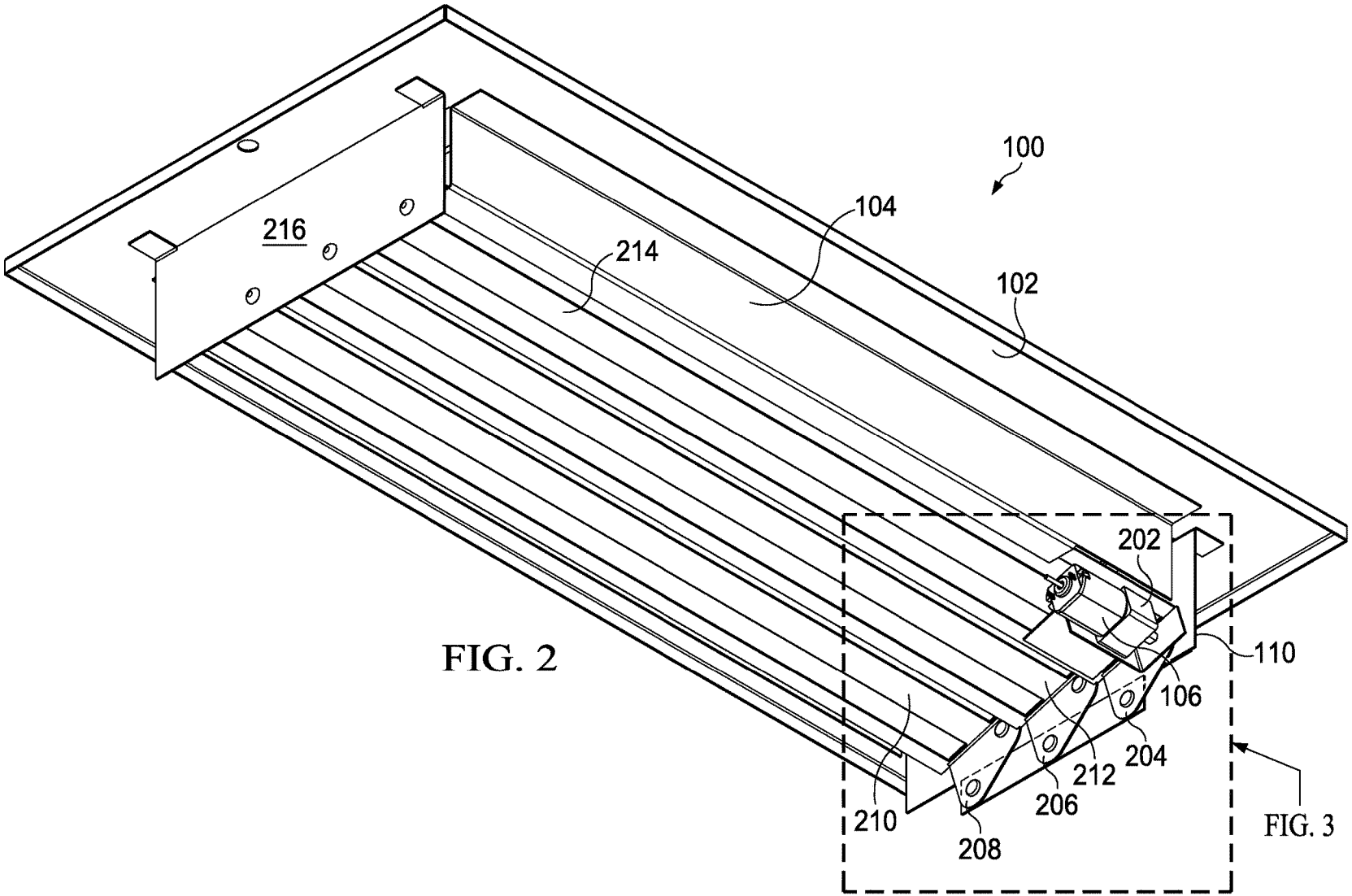
FIG. 2 is a diagram showing the bottom of a damper unit, in accordance with an exemplary embodiment of the present disclosure.

FIG. 2 is a diagram showing the bottom of damper unit 100, in accordance with an exemplary embodiment of the present disclosure. FIG. 2 includes gearbox 202 and blade arm 204 and blade 214, blade arm 206 and blade 212, blade arm 208 and blade 210, and support 216, which can each be fabricated from metal, plastic, composite materials, other suitable materials or a combination of materials.

Gearbox 202 is used to reduce the number of rotations and increase the amount of torque provided by actuator 106 to drive shaft 108. In one exemplary embodiment, gearbox 202 can include spur gears, planetary gears, helical gears, herringbone gears or other suitable gears that are used transmit torque from actuator 106 at a high number of revolutions per minute and a low torque, to a low number of revolutions per minute and a high torque.

Blade arm 204 and blade 214, blade arm 206 and blade 212, blade arm 208 and blade 210, and support 216 are configured to allow the rotation of blades 210, 212 and 214 from the application of force from drive shaft 108 to blade arm 204. In one exemplary embodiment, each blade arm can be coupled to a transmission assembly that transmits force to or from an adjacent blade arm.

Further to this exemplary embodiment, drive shaft 108 can be keyed to interlock with support 110. Actuator 106 can also be mounted on blade arm 204, such that when actuator 106 is activated, drive shaft 108 remains static relative to support 110 but causes actuator 106 housing to rotate, such that actuator 106 and blade arm 204 rotates to cause blade 210, blade 212 and blade 214 to open or close.

Figure 3:
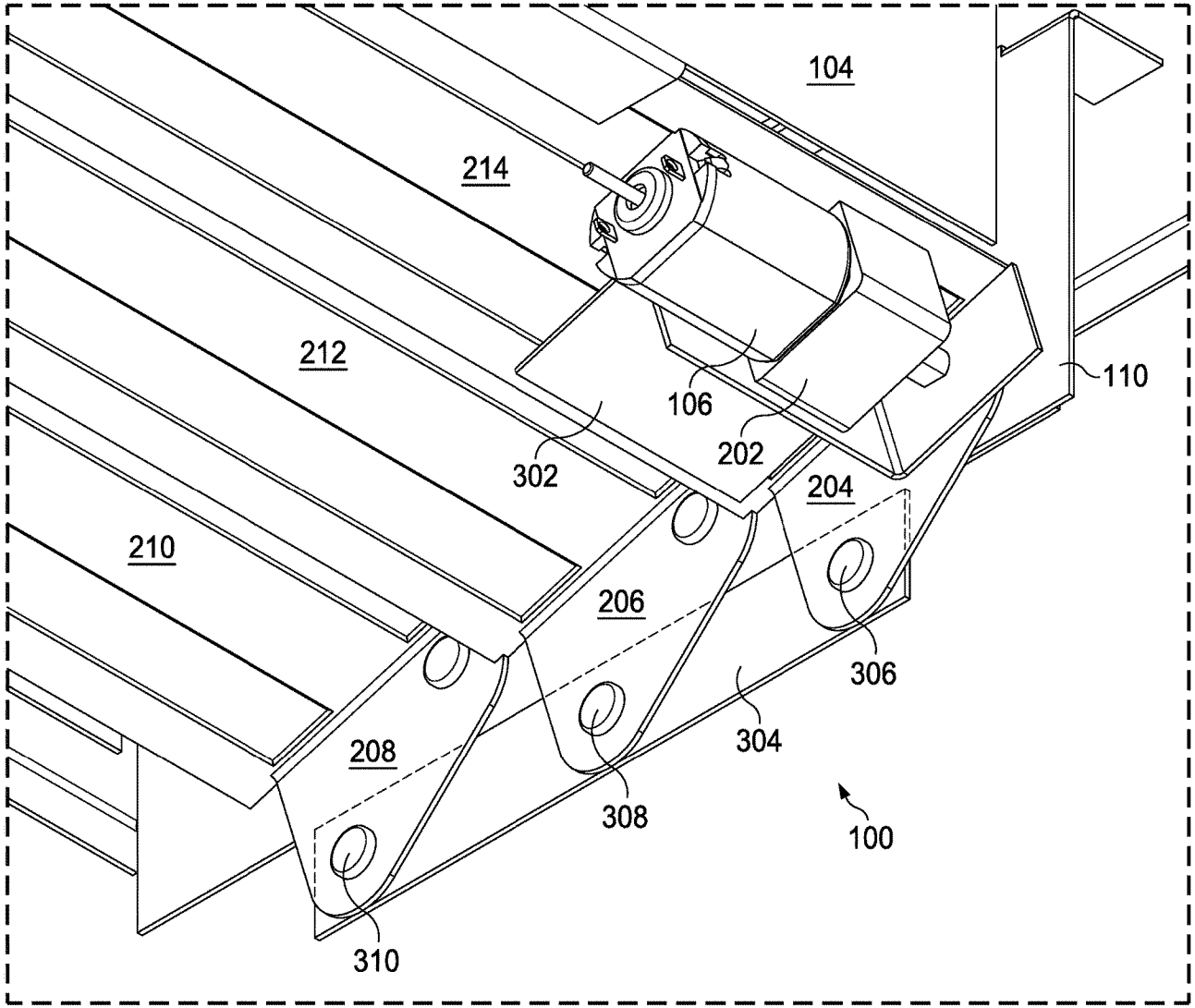
FIG. 3 is a diagram showing a detail view of a damper unit, in accordance with an exemplary embodiment of the present disclosure.

FIG. 3 is a diagram showing a detail view of damper unit 100, in accordance with an exemplary embodiment of the present disclosure. FIG. 3 includes blade shaft 304, which is coupled to blade arms 204, 206 and 208 by bearings 306, 206 and 208, respectively. When blade arm 204 rotates on drive shaft 108, a force is applied to blade shaft 304 that is transferred through blade shaft 304 to blade arms 206 and 208, which open blades 212 and 210, respectively. Support 302 is coupled to actuator 106, gearbox 202 and blade 214, and transfers force from actuator 106 to blade 214 to cause blade 214 to rotate.

In operation, placement of actuator 106 on blade 214 reduces the footprint of actuator 106 within the vent opening of grill 102. Unlike prior art designs that use an actuator 106 that is placed adjacent to blades 210, 212 and 214, and which thus reduces the vent opening area, damper unit 100 results in an increase in the area of the opening of grill 102, which reduces pressure drop and increases flow rate.

Figure 4:
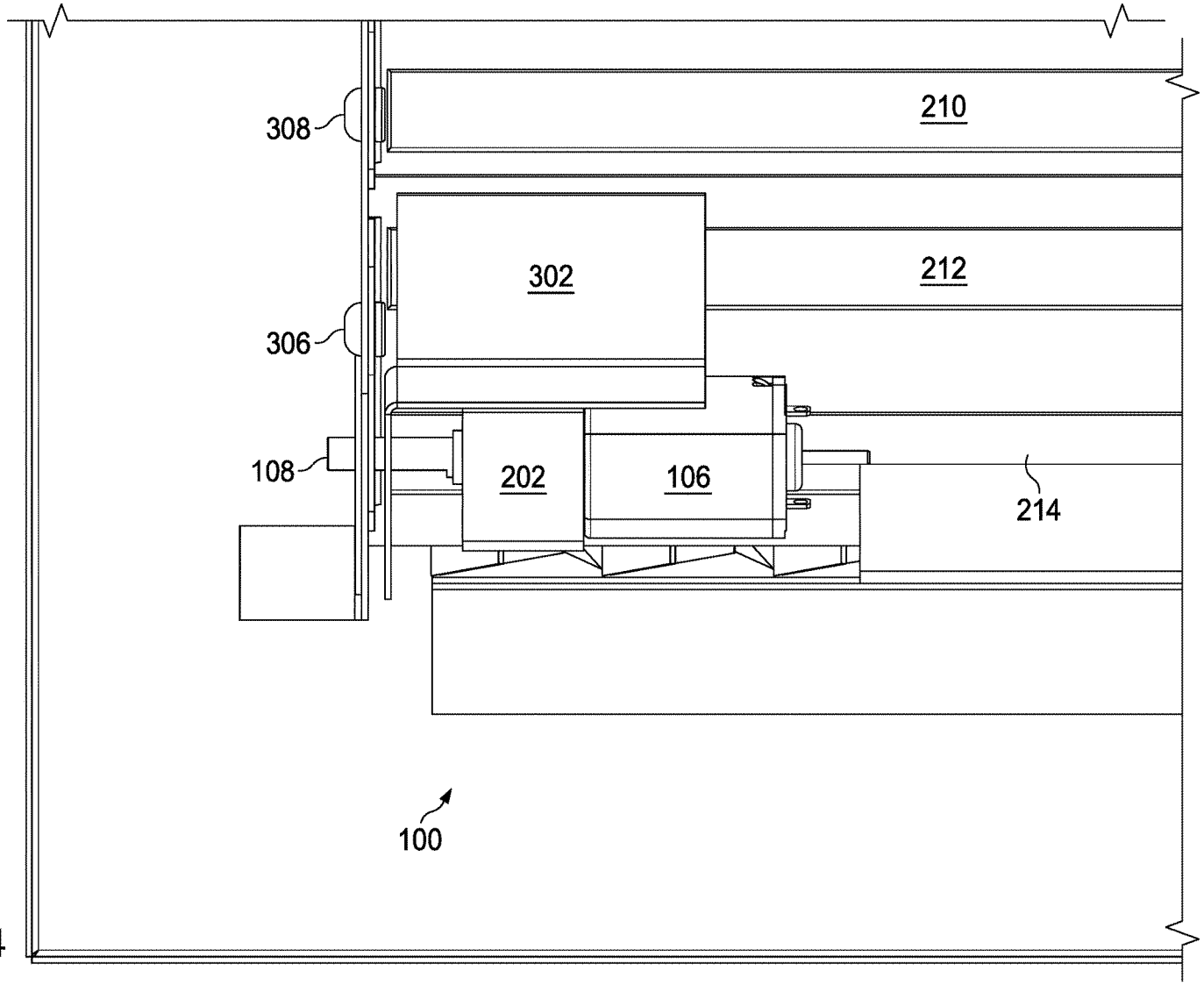
FIG. 4 is a diagram showing a detail view of a damper unit, in accordance with an exemplary embodiment of the present disclosure.

FIG. 4 is a diagram showing a detail view of damper unit 100, in accordance with an exemplary embodiment of the present disclosure. As shown in FIG. 4, drive shaft 108 extends through support 302 and interlocks with blade arm 204. Actuator 106 causes gearbox 202 to turn and rotate drive shaft 108, which causes support 302 to cause blade 214 to rotate relative to blade arm 204.

Figure 5A:
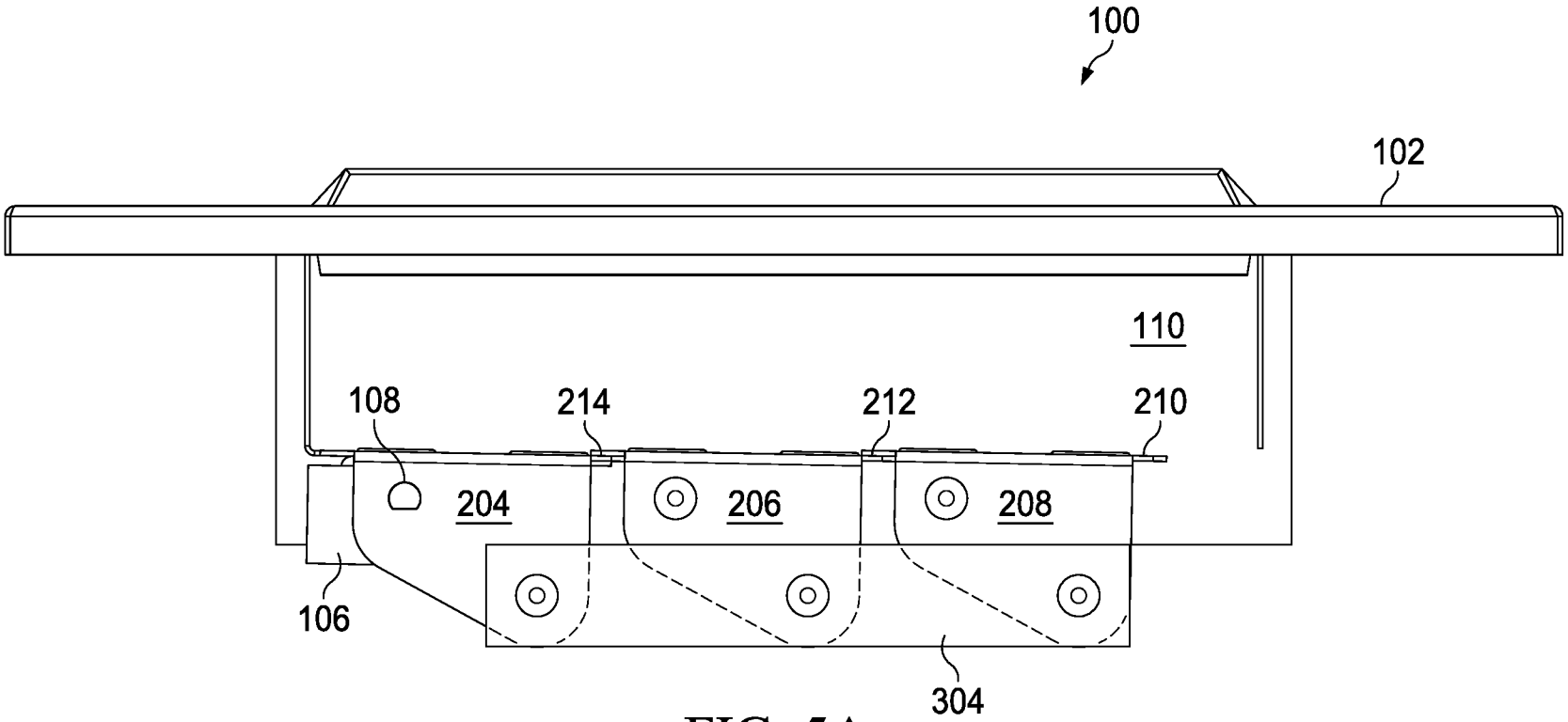
FIGS. 5A and 5B are diagrams showing a damper unit with dampers in an open and closed position, in accordance with an exemplary embodiment of the present disclosure.
Figure 5B:
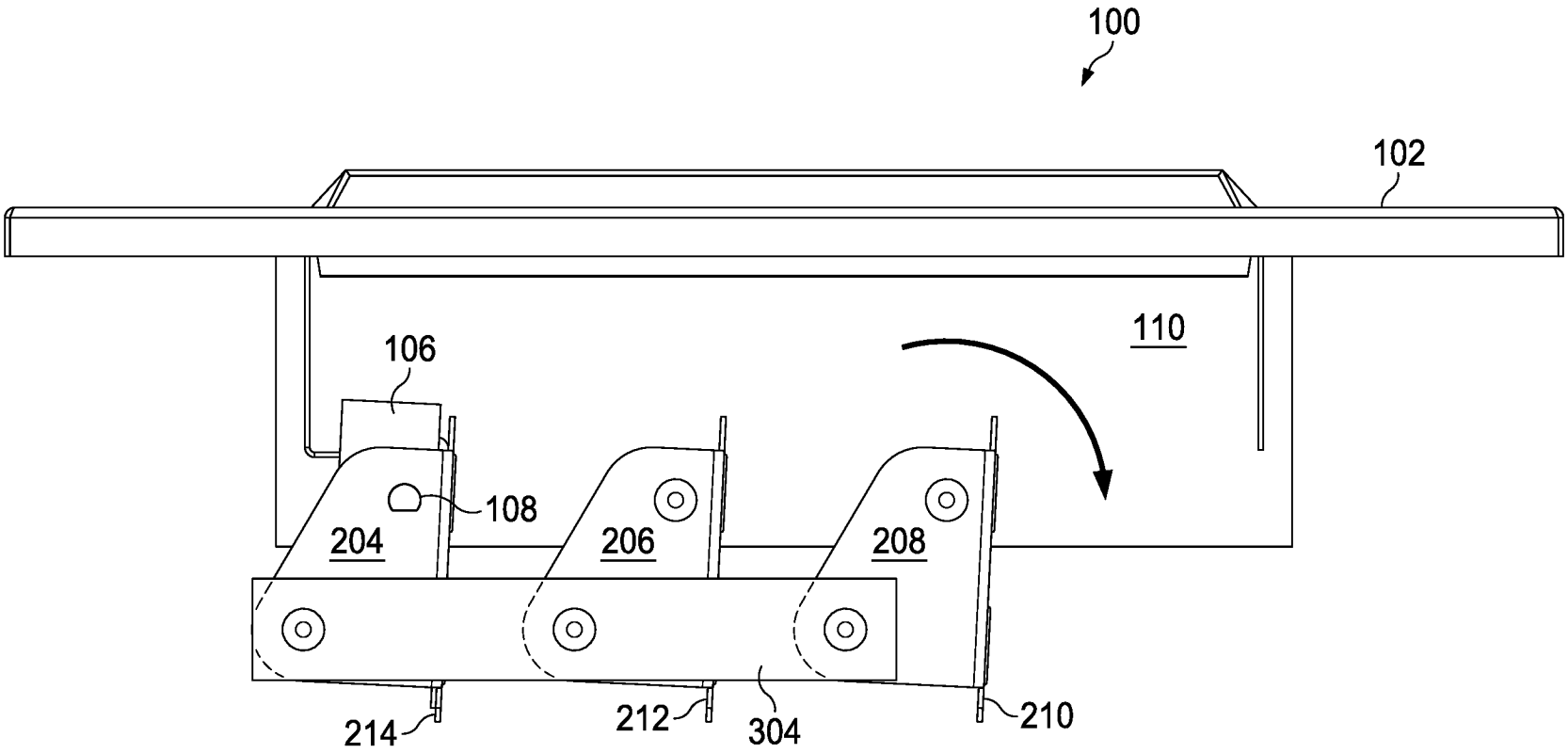

FIGS. 5A and 5B are diagrams showing damper unit 100 with dampers in a closed and open position, respectively, in accordance with an exemplary embodiment of the present disclosure. As shown in FIG. 5A, blade arms 204, 206 and 208 are coupled to blades 214, 212 and 210, respectively, and are in a closed position, with blades 214, 212 and 210 flush and aligned. In FIG. 5B, blade arms 204, 206 and 208 and blades 214, 212 and 210, respectively, have rotated 90 degrees, such that blades 214, 212 and 210 are fully opened. Notably, drive shaft 108 remains fixed with respect to support 110, but actuator 106 rotates with blade 214 and blade arm 204, to which it is attached.

Figure 6A:
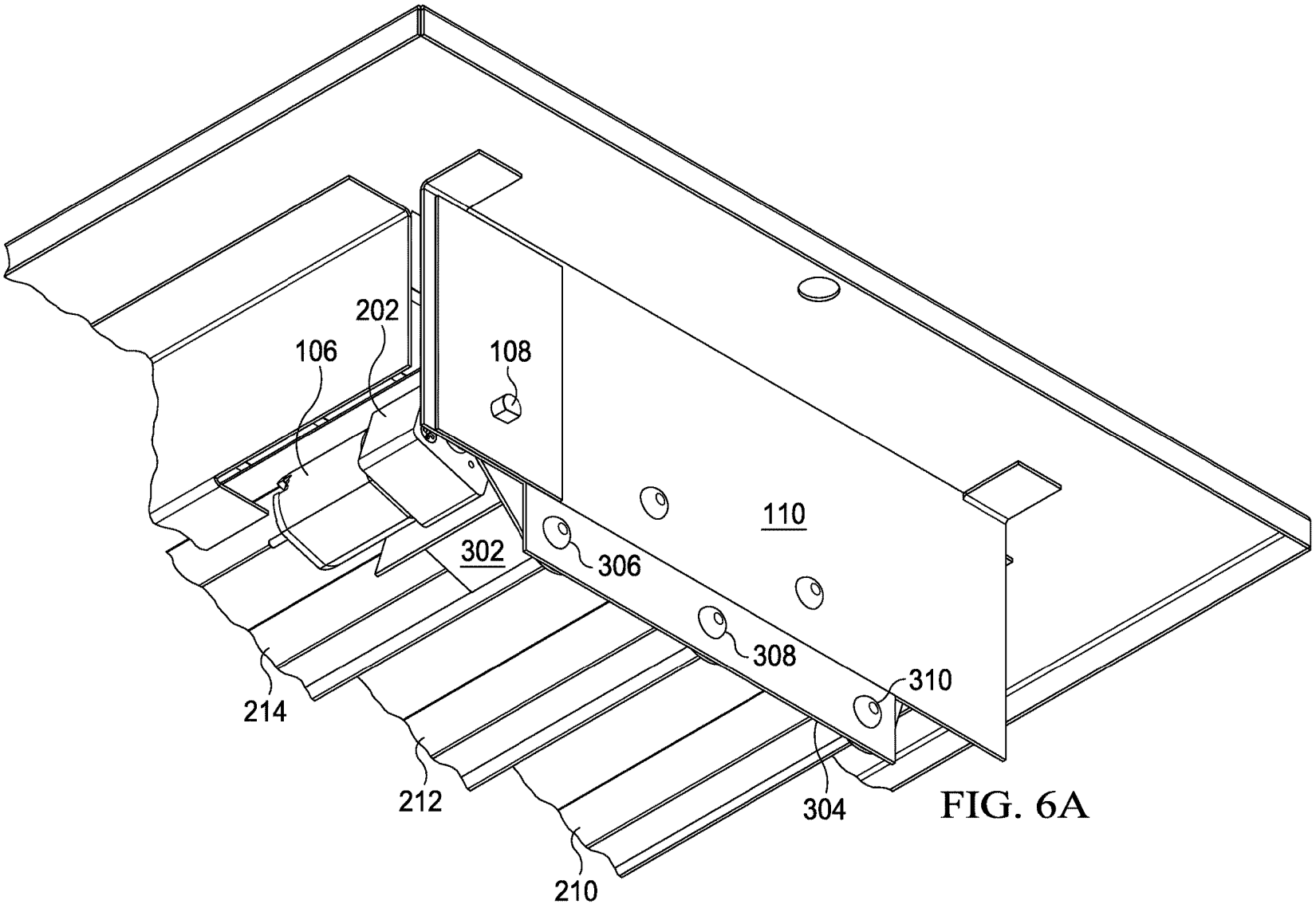
FIGS. 6A through 6C are a sequence of views showing blade arms and blades, respectively, rotating from a closed to an open position.
Figure 6B:
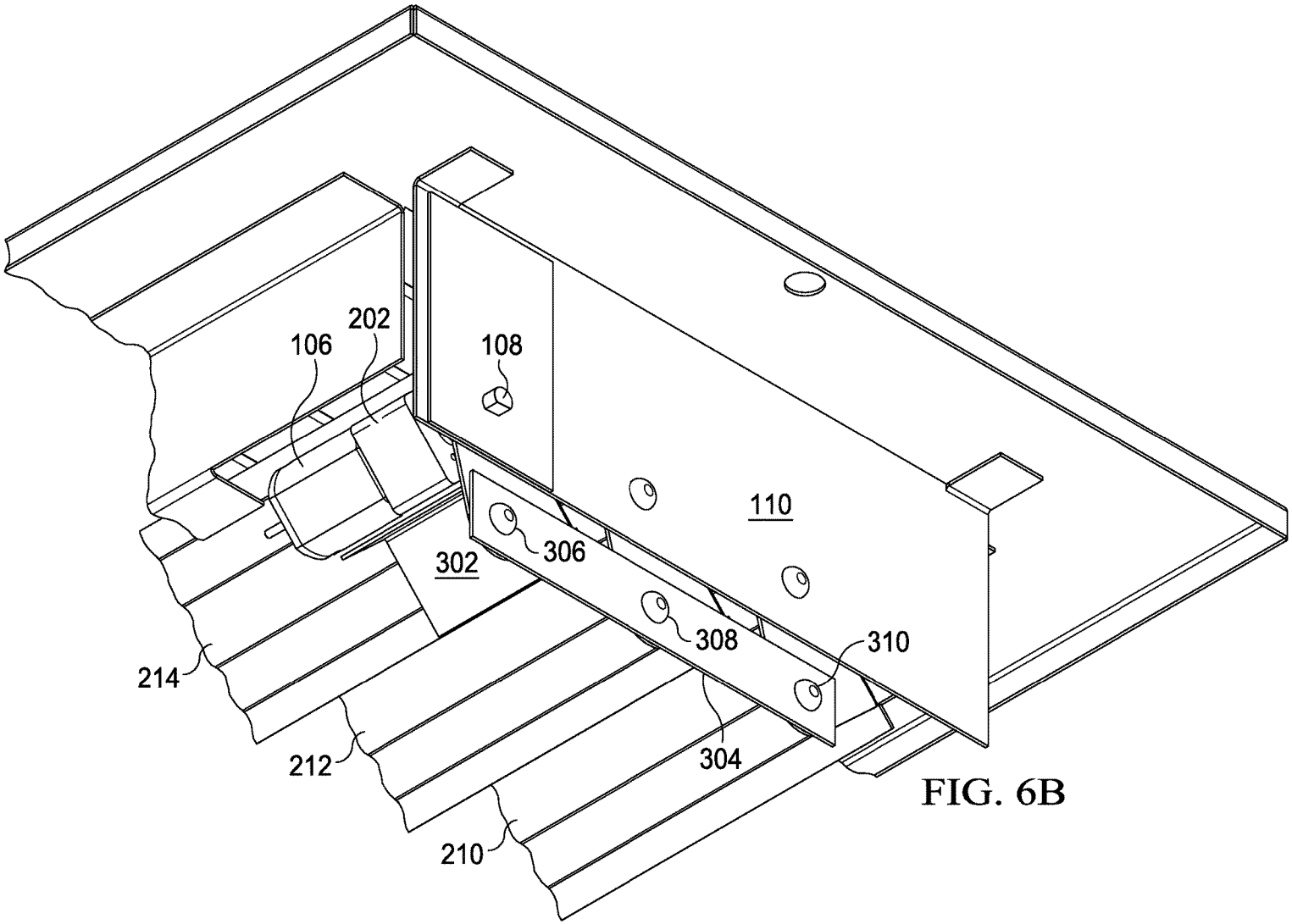
Figure 6C:
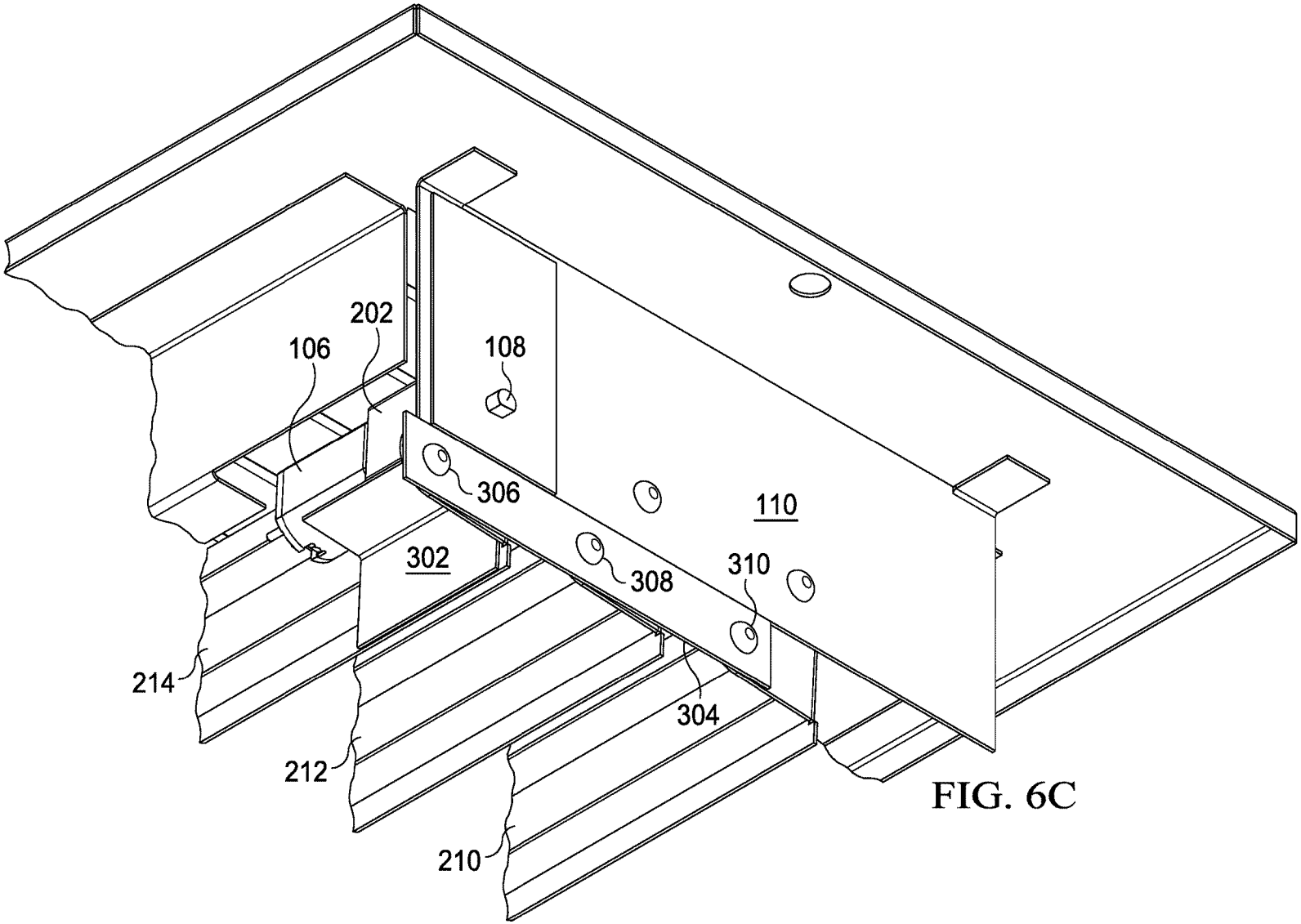

FIGS. 6A through 6C are a sequence of views showing blade arms 204, 206 and 208 and blades 214, 212 and 210, respectively, rotating from a closed to an open position. In FIG. 6A, blades 214, 212 and 210 are in a closed position, and blade shaft 304 is adjacent to support 110. In FIG. 6B, blade 214, 212 and 210 have started to rotate, and blade shaft 304 is separated from support 110. It can also be seen that shaft 108 remains fixed with respect to support 110 as the blades rotate, but that actuator 106 and support 302 rotate with blade arm 204 and blade 214. FIG. 6C shows blades 214, 212 and 210 in a fully open position, with blade shaft 304 adjacent to support 110 in a new location that is different from the location of blade shaft 304 when blades 214, 212 and 210 are closed. In addition, support 302 can be more clearly seen in FIG. 6C, and it can also be seen that shaft 108 has remained fixed in support 110.

Figure 7:
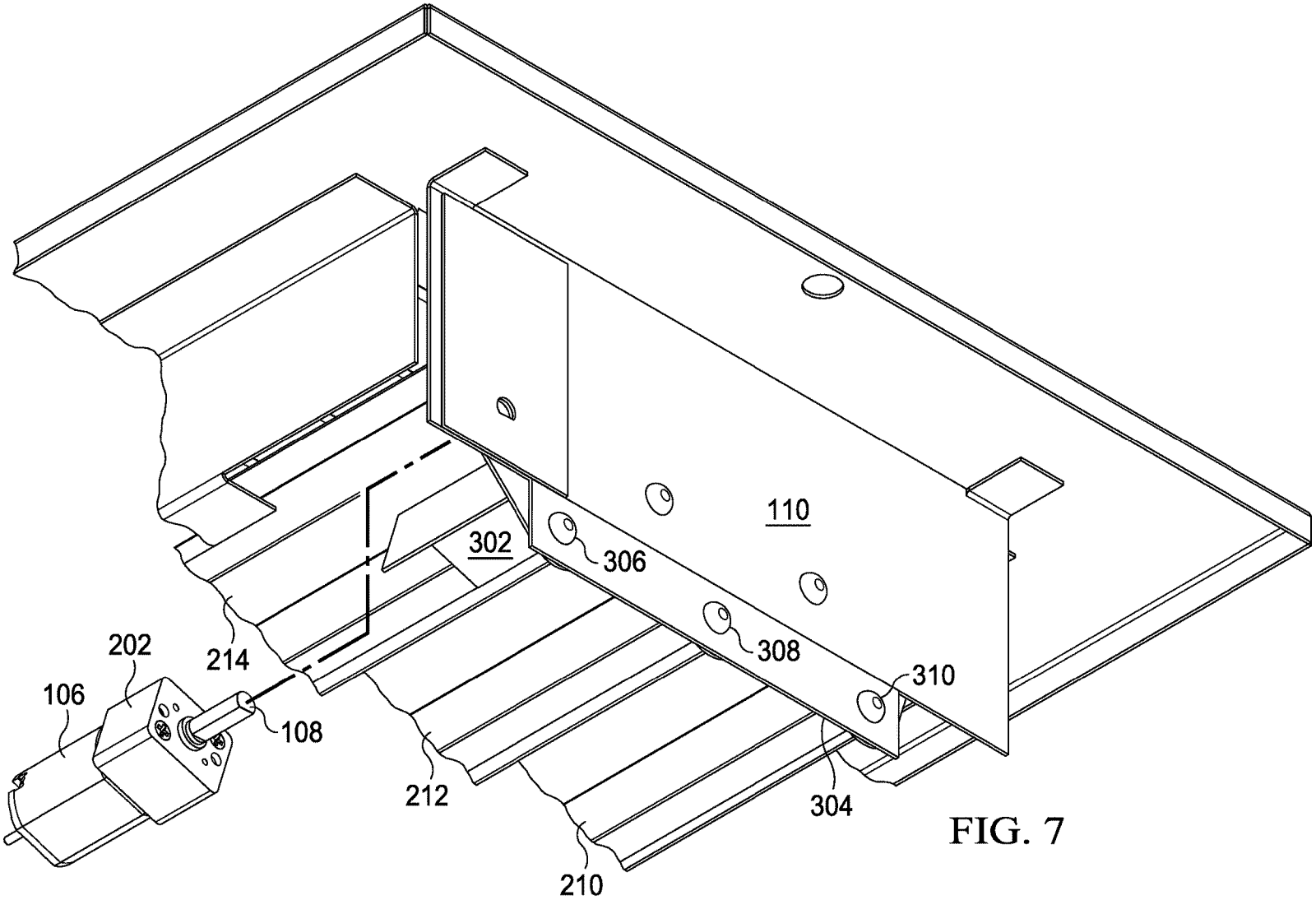
FIG. 7 is a diagram showing how the actuator, gearbox and shaft interface with the support.

FIG. 7 is a diagram showing how actuator 106, gearbox 202 and shaft 108 interface with support 110. Gearbox 202 and/or actuator 106 are coupled to support 302, which is in turn coupled to blade arm 204 and/or blade 214, so as to transfer torque from gearbox 202 and/or actuator 106 to blade arm 204 and/or blade 214. Blade arm 204 and/or blade 214 in turn transfer torque to blade arms 206 and 208 and blades 212 and 210, respectively, through blade shaft 304.

It should be emphasized that the above-described embodiments are merely examples of possible implementations. Many variations and modifications may be made to the above-described embodiments without departing from the principles of the present disclosure. All such modifications and variations are intended to be included herein within the scope of this disclosure and protected by the following claims.

What is claimed is:

1. A damper, comprising:

a plurality of blades;

a plurality of blade arms, each blade arm of the plurality of blade arms coupled to one of the plurality of blades; and a motor housing having a motor shaft disposed therein, wherein the motor housing is fixedly attached to one of the plurality of blades or one of the plurality of blade arms so as to rotate with the one of the plurality of blades or the one of the plurality of blade arms and so as to rotate relative to the motor shaft during operation wherein the motor shaft is fixedly coupled to a frame; and a blade shaft coupled to each blade arm of the plurality of blade arms and configured to transfer torque from a first blade arm of the plurality of blade arms to the plurality of blade arms.

2. The damper of claim 1 wherein the motor housing is directly coupled to the one of the plurality of blades or the one of the plurality of blade arms.

3. The damper of claim 1 wherein the motor shaft comprises a keyed shaft, and the keyed shaft of the motor housing is coupled to the frame through an aperture having a matching shape to the keyed shaft.

4. The damper of claim 1 wherein each blade arm of the plurality of blade arms comprises a bearing.

5. The damper of claim 1 wherein each blade arm of the plurality of blade arms comprises a first bearing and a second bearing.

6. The damper of claim 1 further comprising a gearbox coupled to the motor housing and the one of the plurality of blade arms or the one of the plurality of blades.

7. The damper of claim 1 further comprising a gearbox coupled to the motor shaft and the one of the plurality of blade arms.

8. The damper of claim 1 further comprising a support coupled to the one of the plurality of blades and the motor housing, wherein the support is configured to mount the motor housing to the one of the plurality of blades.

9. A damper, comprising:

a frame;

a plurality of blades rotatably disposed in the frame;

a plurality of blade arms, each blade arm of the plurality of blade arms coupled to one of the plurality of blades; and a motor having a motor shaft, wherein the motor is fixedly attached to one of the plurality of blades or one of the plurality of blade arms such that the motor rotates, during operation, relative to the motor shaft wherein the motor shaft is fixedly coupled to the frame; and a blade shaft coupled to each blade arm of the plurality of blade arms and configured to transfer torque from a first blade arm of the plurality of blade arms to the plurality of blade arms.

10. The damper of claim 9 wherein the motor is directly coupled to the one of the plurality of blades or the one of the plurality of blade arms.

11. The damper of claim 9 wherein the motor shaft comprises a keyed shaft, and the keyed shaft of the motor is coupled to the frame through an aperture having a matching shape to the keyed shaft.

12. The damper of claim 9 wherein each blade arm of the plurality of blade arms comprises a bearing.

13. The damper of claim 9 wherein each blade arm of the plurality of blade arms comprises a first bearing and a second bearing.

14. The damper of claim 9 further comprising a gearbox coupled to the motor shaft.

15. The damper of claim 9 further comprising a gearbox coupled to the motor and the one of the plurality of blade arms.

16. A damper, comprising:

a plurality of blades;

a plurality of blade arms, each blade arm of the plurality of blade arms coupled to one of the plurality of blades, wherein each blade arm of the plurality of blade arms comprises a first bearing and a second bearing;

a blade shaft coupled to each blade arm of the blade arms and configured to transfer torque from a first blade arm of the plurality of blade arms to plurality of blade arms;

a motor housing coupled to one of the plurality of blades or one of the plurality of blade arms, wherein the motor housing further comprises a keyed shaft, and the keyed shaft of the motor housing is coupled to a frame through an aperture having a matching shape to the keyed shaft;

a gearbox coupled to the motor housing and the one of the plurality of blade arms and a support coupled to the one of the plurality of blades or the one of the plurality of blade arms and to the motor housing, wherein the support is configured to secure the motor housing to the one of the plurality of blades or the one of the plurality of blade arms to enable rotation of the motor housing with the one of the plurality of blades or the one of the plurality of blade arms.

* * * * *